United States Patent [19]

Freeman

[11] Patent Number: 4,506,986

[45] Date of Patent: Mar. 26, 1985

[54] METHOD AND APPARATUS FOR PREPARATING LIQUID MIXTURES

[75] Inventor: Barrie A. Freeman, Wickford, England

[73] Assignee: Ciba-Geigy AG, Basel, Switzerland

[21] Appl. No.: 534,955

[22] Filed: Sep. 22, 1983

[30] Foreign Application Priority Data

Oct. 4, 1982 [GB] United Kingdom ..... 8228310
Apr. 20, 1983 [GB] United Kingdom ..... 8310702

[51] Int. Cl.[3] ..... B01F 15/00

[52] U.S. Cl. ..... 366/142; 137/563; 137/565; 354/324; 354/331; 366/166; 366/341

[58] Field of Search ..... 366/131, 132, 136, 137, 366/159, 142, 166, 167, 182, 341, 153, 348; 354/324, 297, 325, 344, 331; 222/64; 137/565, 563, 571, 574; 118/429; 134/186, 182, 64 P, 122 P

[56] References Cited

U.S. PATENT DOCUMENTS

| | | | |
|---|---|---|---|
| 974,336 | 11/1910 | Alt | 366/166 |
| 3,764,736 | 8/1973 | Statham et al. | 366/341 X |
| 3,851,662 | 12/1974 | Jessop | 354/324 X |
| 3,858,229 | 12/1974 | Stievenart et al. | 354/331 |
| 4,119,989 | 10/1978 | Carvalko et al. | 354/324 X |
| 4,165,186 | 8/1979 | Tortorich et al. | 366/142 |
| 4,312,586 | 1/1982 | Ohtani | 354/324 X |
| 4,332,455 | 6/1982 | Stettner | 366/166 X |
| 4,408,891 | 10/1983 | Schirk et al. | 366/166 X |

FOREIGN PATENT DOCUMENTS

| | | | |
|---|---|---|---|
| 2739293 | 3/1979 | Fed. Rep. of Germany | 354/324 |
| 1333422 | 10/1973 | United Kingdom . | |

*Primary Examiner*—Timothy F. Simone
*Attorney, Agent, or Firm*—Harry Falber

[57] ABSTRACT

Liquid mixtures are prepared in first and second containers (3 and 4). The first container (3) has an outlet (6) spaced from the bottom of the container and communicating with an inlet (7) to the second container (4). A measured amount of first liquid is poured into the first container and fills the latter to the height ($h_1$) of the outlet, the remainder flowing under gravity into the second container, whereby the first liquid is distributed between the first and second containers in proportions dependant upon the height ($h_1$) of the outlet (6) and the basal areas of the two containers.

A hollow tubular extension (15) is then fitted with one of its ends to said outlet and at the other end has mixture-preventing means (18) for receiving a flow of second liquid and defining an overflow outlet (16) spaced above the outlet (6).

The second liquid is introduced into the mixture-preventing means and flows firstly into the first container to fill the latter to the level of the overflow outlet (16) and then flows through said overflow outlet into the second container to fill the latter to a desired level. Thereby mixtures of said first and second liquids are formed in said first and second containers and may be of the same of different strengths.

The method and apparatus described are particularly suitable for forming dilute solutions of concentrated liquids such as may be used in photographic developing and fixing, since an operator does not have to measure out quantities of possibly corrosive or hazardous liquids.

9 Claims, 4 Drawing Figures

METHOD AND APPARATUS FOR PREPARATING LIQUID MIXTURES

Figure 1:
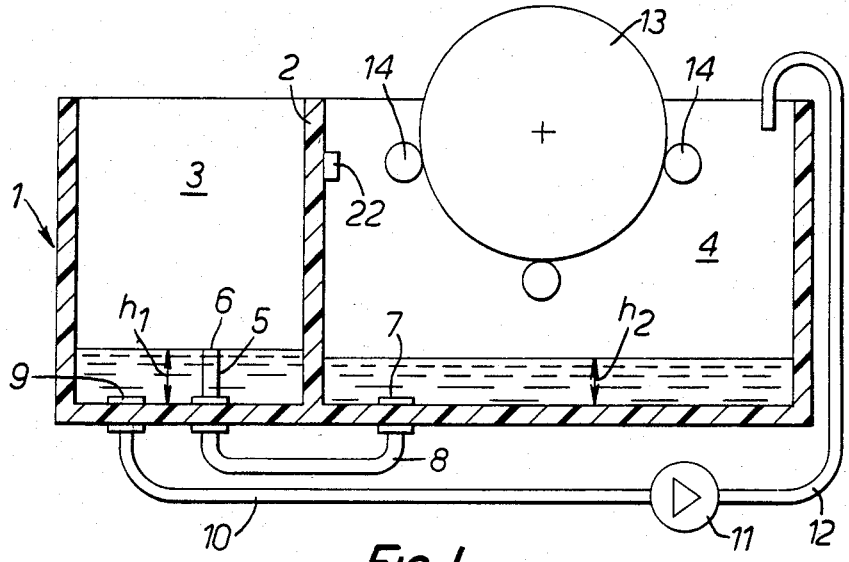

This invention relates to a method of and apparatus for preparing liquid mixtures. The invention is particularly, but not exclusively, concerned with preparing dilute solutions from a concentrated liquid and a diluent but it will be appreciated that it may be employed where mixtures of miscible liquids are required.

In many manufacturing processes or processes in which material is treated in a liquid, it is necessary to prepare treatment liquids of predetermined strength as accurately and as quickly as possible. In many cases it is desirable to prepare a bath of treatment liquid of one strength and a bath of replenishment liquid of the same or different strength for replenishing the bath of treatment liquid as liquid is lost from the bath by evaporation, reaction or carry over on material passed through the bath. This is particularly the case where sheet material is passed through a bath of treatment liquid.

In order to prepare the two baths, four liquid measurements are required, two of which may involve a concentrated liquid and two of which may involve a diluent. If the concentrated liquid is highly caustic or acidic or otherwise presents a health hazard, it is obviously undesirable to carry out a number of measurements involving the concentrated liquid.

It is an object of the invention to provide a method and apparatus with which liquid mixtures for a treating bath and an associated replenishment bath can be prepared easily and simply and preferably without the necessity for making any measurement on either liquid.

According to one aspect of the present invention there is provided a method of preparing liquid mixtures in a first container and in a second container by introducing different amounts of a first and a second liquid into each of said containers, characterised in that a measured quantity of first liquid is introduced into said first container, the first container having an outlet spaced from the bottom of the container and there being means connecting said outlet of the first container to an inlet to the second container such that liquid can flow under gravity through said outlet into said second container, the measured quantity of first liquid introduced into said first container being greater than the amount which can be retained in said first container, whereby some of said liquid will flow through said connecting means into said second container, the height of said outlet above the base of the first container and the areas of the bases of said containers being such as to result in a desired distribution of the first liquid between the containers, and in that hollow tubular extension means formed at its upper end with an overflow outlet and provided with mixture-preventing means is fitted to said outlet and second liquid into said mixture-preventing means to flow firstly into the first container until the latter is filled to the level of the overflow outlet and secondly through said overflow outlet into the second container without substantially mixing with the liquid in the first container.

According to another aspect of the present invention there is provided apparatus for use in preparing liquid mixtures, comprising a first container and second container and means connecting the containers, characterised in that the first container has an outlet spaced from the bottom of the container, the height of said outlet above the bottom of the container and the area of the base of the container being such that a predetermined amount of a first liquid can be retained in said container before further liquid will overflow through said outlet, and the second container has an inlet, there being means connecting said outlet of the first container to said inlet of the second container to permit liquid overflowing said outlet to flow under gravity into said second container, and in that hollow tubular extension means for said outlet means and operative to permit the level of liquid in the first container to be raised above the level of said outlet, said extension means defining at its upper end an overflow outlet and having mixture-preventing means adapted to receive a flow of said second liquid; the arrangement being such that when a measured quantity of a first liquid to be mixed is poured into the first container, in the absence of said extension, a predetermined amount will remain therein and the remainder will flow through said connecting means into said second container, and such that, when the extension is then fitted to said outlet means, a second liquid may be introduced into said mixture-preventing means such that said second liquid can flow firstly from said means into the first container to fill the latter to the level of the overflow outlet and secondly through said overflow outlet into the second container without substantially mixing with the liquid in the first container, thereby to produce in said containers liquid mixtures the strengths of which are determined by the areas of the bases of the containers and by the heights above the bottoms of the containers reached by said first liquid and by the mixtures of first and second liquids in said containers.

By pouring a standard amount of a first liquid, e.g., a concentrated liquid, into the first container, and by then feeding in a supply of a second liquid, e.g., a diluent, until the second container is filled to a given level a supply of treating liquid and replenishment liquid can be prepared without the necessity for the operator to make any measurement on either of the liquids. In this connection, it is to be appreciated that the standard amount of first liquid may be presented to the operator as a bottle or other receptacle filled with a standard amount of liquid.

After the introduction of the first liquid, it is particularly simple to prepare the required solutions since the second liquid is then introduced into the mixture-preventing means until such time as the second container is filled to the required level. The second liquid is supplied to the said mixture-preventing means and will first flow into the first container to fill it and will then pass down the overflow at the upper end of the hollow tubular extension to fill the second container, which may be provided with means for indicating when the desired level of filling has been reached and optionally for interrupting the flow of second liquid.

In order to allow the containers to be used to provide solutions of different strengths, tubular extension pieces of various lengths may be provided and the indicating means may be adjustable in height.

Other features and objects of the method and apparatus of the present invention are to be found in the claims.

Figure 2:
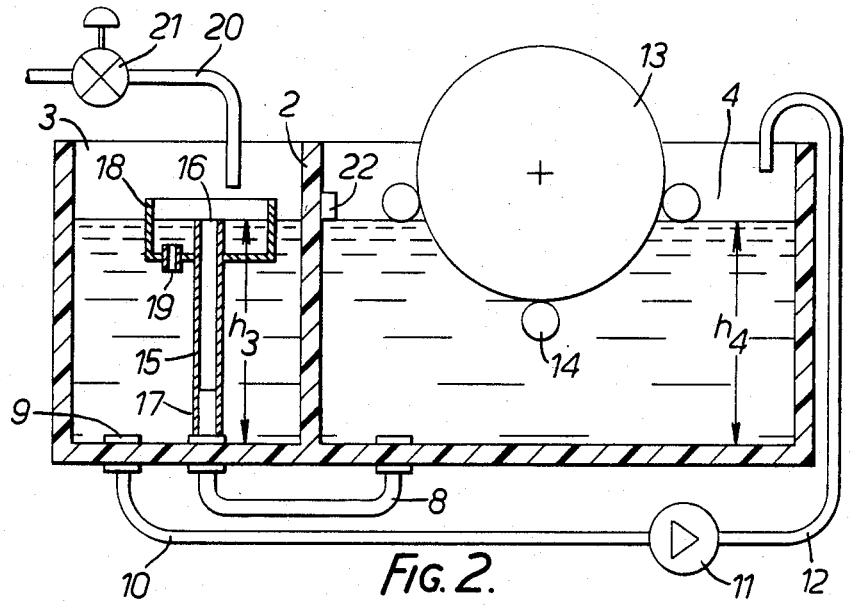
Figure 3:
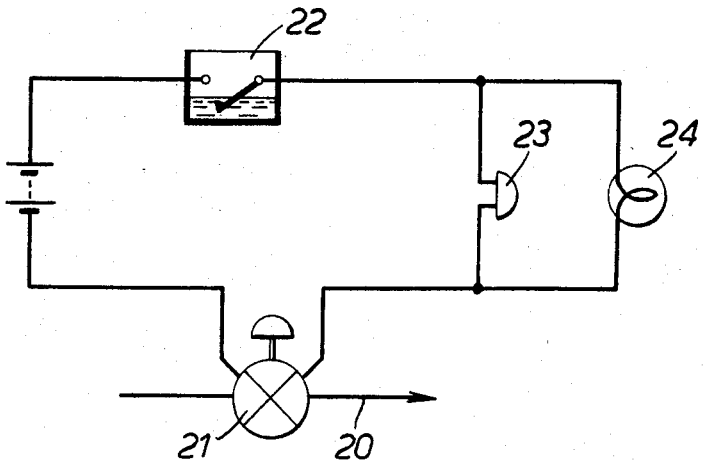
Figure 4:
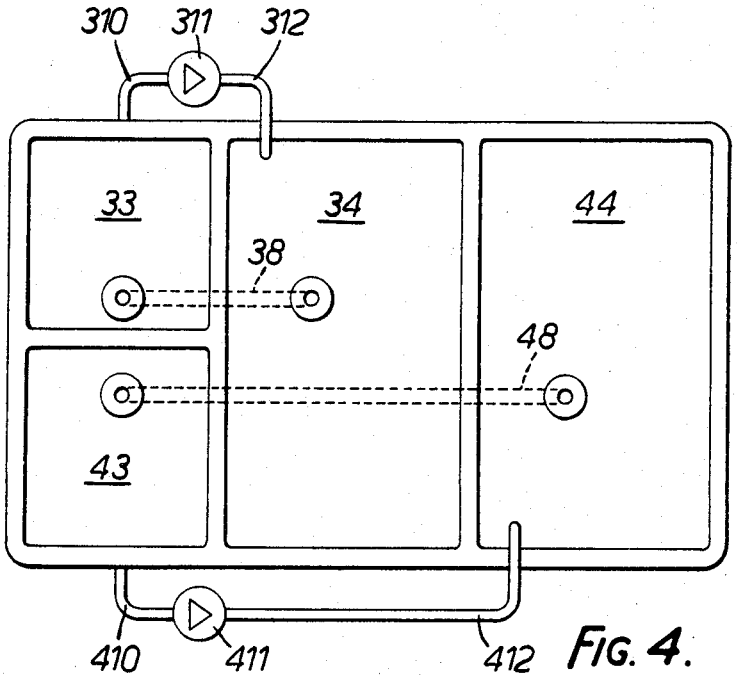

In order to enable the invention to be more readily understood, reference will now be made to the accompanying drawings, which illustrate diagrammatically and by way of example two embodiments thereof, and in which:

FIG. 1 is a cross-sectional view of apparatus comprising a treatment container and a replenishment container, FIG. 2 is a view similar to FIG. 1 showing the containers full of dilute solutions, FIG. 3 is a circuit diagram, and FIG. 4 is a diagrammatic plan view of a compound apparatus having two treatment containers and two replenishment containers.

Referring now to FIGS. 1 and 2 of the drawings, there is shown apparatus for preparing two dilute solutions of different strengths from a given amount of a concentrated liquid. The apparatus comprises a trough or housing 1 which is conveniently made of plastics material and which is divided by a partition wall 2 into a first or replenishment container 3 and a second or treatment container 4.

An outlet pipe 5 is located in the base of the replenishment container 3 with its outlet 6 spaced a distance $h_1$ above the base of the container. The outlet pipe 5 is connected to an inlet 7 in the base of the treatment container by a feed pipe 8. A further outlet 9 in the base of the container 3 is connected via a supply pipe 10 to a pump 11 which is in turn connected to another pipe 12 leading into the top of the treatment container 4.

A rotatable drum 13 is mounted in bearings (not shown) in the side walls of the treatment container and is engaged by three guide rollers 14 also mounted in the side walls.

In the use of the apparatus just described, sheet material is passed between the rollers 14 and the drum 13 through a bath of treatment liquid contained in the container 4. As liquid is lost from the container by carry over on the sheet material, replenishment liquid is pumped at required intervals from the container 3 to the container 4 by the pump 11. The apparatus is particularly suitable for treating photographic material using a developing, fixing or like treatment solution in the treatment container and a solution of the same treatment liquid, usually of a different strength in the replenishment container. In order to make up the two solutions, it has previously been the practice to measure out two different quantities of concentrated treatment liquid, dilute them with different amounts of water and then pour them into the respective containers. Very often concentrated developing solutions are used which are extremely caustic while concentrated fixing solution is acidic and contains sulphite ions which act as a reducing agent. It would thus be extremely advantageous not to have to measure out different quantities of either of these concentrated solutions. With the present apparatus, however, the dilute solutions can be prepared in a simple manner, obviating the necessity for making separate measurements on the concentrated liquids involved.

In order to prepare the required solutions, a predetermined quantity of concentrated liquid is poured into the container 3. The liquid will fill the container to the level of the overflow 6 and further liquid will then flow through the pipe 8 into the container 4, and will fill the latter to, say, the height $h_2$ as shown in FIG. 1. In this connection it will be appreciated that the areas of the bases of the containers 3 and 4, the height of the overflow 6 above the base of the container 3 and the predetermined quantity of concentrated liquid are so chosen that when the containers 3 and 4 are subsequently filled with water or other diluent to prescribed heights the resulting solutions in the containers have the required strengths. For example, it is convenient to construct the apparatus such that when a standard 2 liter bottle of concentrated liquid is poured into the container 3, it will fill the containers 3 and 4 to the levels $h_1$ and $h_2$ respectively as shown in FIG. 1 and such that when the containers are subsequently filled with water to the levels $h_3$ and $h_4$ shown in FIG. 2, solutions of the required strengths are obtained. It will also be appreciated that the containers may be filled so that the level of liquid in each container is the same and is even above the outlet 6, and that the height of the liquid in the container 4 can be the same as or less than but never more than the height of the liquid in the container 3.

After the concentrated liquid has been poured into the apparatus, a tubular hollow stand pipe 15 is placed over the outlet to raise the level of the overflow from the container 3 to the end 16 of the stand pipe. One end 17 of the stand pipe is secured over the outlet pipe 5 by an interference fit, and the other or upper end of the stand pipe 15 is surrounded by a cup-shaped member 18 formed with an outlet 19. Water or other diluent, is now introduced into the cup-shaped member 18 from a water-supply pipe 20 controlled by a tap or valve 21. Water flows into the cup-shaped member and out through the outlet 19 until the container 3 is filled to the level $h_3$ at the height of the outlet end 16 of the stand pipe. When the container 3 is filled, the water will flow through the outlet 16 of the stand pipe, through the stand pipe 15, outlet pipe 5 and feed pipe 8 into the container 4 until the latter has been filled to a desired height $h_4$ when the supply of water is switched off. Again the height $h_4$ may be the same as or less than the height of the liquid level in the container 3, but never greater.

The water supply may be switched off when the operator sees that the level in the container 4 has reached a particular mark, but it is preferred to provide the container 4 with a liquid level indicator 22. This may conveniently be in the form of a simple float switch as shown in FIG. 3 which shows the float switch 22 connected in circuit with indicating means such as a bell 23 or warning light 24 either or both of which may be present to warn the operator that the container 4 has been filled to the required level. FIG. 3 also shows that the float switch may be used to control the valve 21 and cut off the supply of water once the container 4 is filled to the required level.

If it is desired to produce solutions of different strengths using the same apparatus, it is possible to provide a number of stand pipes 15 of different lengths and to make the height of the float switch 22 above the base of the container 4 adjustable so that by appropriate selection of a stand pipe and adjustment of the switch the strengths of the two solutions can be altered.

It will be appreciated that many modifications of the apparatus just described may be made. The two containers may be separate from one another, but such an arrangement is not so convenient as problems may be encountered if they are placed at different levels from that or those intended. However, this may be a useful arrangement if the containers are fixed in position since it would enable replenishment and treatment solution to be prepared at a replenishment tank remote from a treatment area, this being particularly useful if the operation in the treatment area should result in the production of hazardous or noxious fumes. Furthermore, the outlet pipe 5 may be located in a side wall of the container 3, provided that its overflow outlet 6 can be covered in a leakproof manner by an appropriately shaped stand pipe.

A particularly preferred modification of the apparatus is shown diagrammatically in FIG. 4. The apparatus shown in FIG. 4 comprises a first or replenishment tank 33 for replenishment developer solution connected via a feed pipe 38, and supply pipes 310 and 312 and a pump 311 with a second or developing tank 34. The apparatus also comprises a first or replenishment tank 43 for fixer connected via a feed pipe 48 and supply pipes 410 and 412 and a pump 411 with a second or fixing tank 44. It will be seen that the two first tanks 33 and 43 are located side by side whereas the developing and fixing tanks are so arranged that photographic material can be fed firstly through the developing tank and secondly through the fixing tank on rotatable drums which are not shown in FIG. 4 but which are the same as those shown in FIGS. 1 and 2. It will be seen that the apparatus of FIG. 4 provides a neat and simple arrangement for preparing and using developing and fixing solutions for photographic material.

While the present invention has been particularly concerned with the preparation of photographic processing solutions by diluting with water concentrated liquids, it will be appreciated that the invention is of wider applicability and may be used to prepare other mixtures of miscible liquids of desired strengths.

I claim:

1. A method of preparing liquid mixtures in a first container and in a second container by introducing different amounts of a first and a second liquid into each of said containers, characterised in that a measured quantity of first liquid is introduced into said first container, the first container having side walls, a base and an outlet spaced from the bottom of the container and the second container having side walls, a base and an inlet, and there being means connecting said outlet of the first container to said inlet of the second container such that liquid can flow under gravity through said outlet into said second container, the measured quantity of first liquid introduced into said first container being greater than the amount which can be retained in said first container, whereby some of said liquid will flow through said connecting means into said second container, the height of said outlet above the base of the first container and the area of the base of each of said continers being such as to result in a desired distribution of the first liquid between the containers, a hollow tubular extension means having an upper end provided with an overflow outlet and with a mixture-preventing means and a lower end fitted to said outlet and introducing second liquid into said mixture-preventing means to flow firstly into the first container until the latter is filled to the level of the overflow outlet and secondly through said overflow outlet into the second container without substantially mixing with the liquid in the first container.

2. A method as claimed in claim 1, wherein an electrical signal is generated when the second container is filled to a desired level, and the electrical signal is used to give an audible or visible warning, or to control the introduction of said second liquid.

3. The method of claim 1, wherein the first liquid is a concentrated liquid and the second liquid is a diluent.

4. Apparatus for use in preparing liquid mixtures, comprising a first container and second container, each having side walls and a base, and means connecting the containers, characterised in that the first container has an outlet spaced from the bottom of the container, the height of said outlet above the bottom of the container and the area of the base of the container being such that a predetermined measured amount of a first liquid can be retained in said container before further liquid will overflow through said outlet, and the second container has an inlet, there being means connecting said outlet of the first container to said inlet of the second container to permit liquid overflowing said outlet to flow under gravity into said second container, and a hollow tubular extension means having a bottom end adapted to fit to said outlet means and operative to permit the level of liquid in the first container to be raised above the level of said outlet, said extension means having an upper end provided with an overflow outlet and mixture-preventing means adapted to receive a flow of said second liquid; the arrangement being such that when the measured quantity of a first liquid to be mixed is poured into the first container, in the absence of said extension, a predetermined amount will remain therein and the remainder will flow through said connecting means into said second container, and such that, when the extension is then fitted to said outlet means, a second liquid may be introduced into said mixture-preventing means such that said second liquid can flow firstly from said means into the first container to fill the latter to the level of the overflow outlet and secondly through said overflow outlet into the second container without substantially mixing with the liquid in the first container, thereby to produce in said containers liquid mixtures the strengths of which are determined by the areas of the bases of the containers and by the heights above the bottoms of the containers reached by said first liquid and by the mixtures of first and second liquids in said containers.

5. Apparatus as claimed in claim 4, wherein the mixture-preventing means is a cup-shaped container fitted around the overflow outlet of the tubular extension and provided with means defining an outlet.

6. The apparatus of claim 4, wherein indicating means is provided for giving an audible or visual signal when the level of the liquid in the container has reached a predetermined level, or for stopping the flow of said second liquid when the level of the liquid in the container has reached a predetermined level.

7. Apparatus as claimed in claim 6, wherein said indicating means is adjustable to vary said predetermined level, and wherein said apparatus is provided with a plurality of tubular extensions of different lengths, whereby mixtures of different strengths may be prepared.

8. The apparatus of claim 4, wherein one of said containers is a treatment container in which a material is subjected to treatment in a bath of liquid, and the other of said containers is a replenishment container, and wherein liquid feeding means is arranged to supply liquid from the replenishment container to the treatment container to make up losses of liquid therefrom.

9. Apparatus as claimed in claim 8, wherein the apparatus comprises a plurality of said replenishment containers each appropriately connected to a respective one of a plurality of said treatment containers, and wherein said treatment containers are arranged so that a series of treatments may be carried out on material passed in turn through each of said treatment containers.

* * * * *